US007618207B2

(12) United States Patent
Thiebaut

(10) Patent No.: US 7,618,207 B2
(45) Date of Patent: Nov. 17, 2009

(54) DEVICE FOR PACKAGING AND APPLYING A PRODUCT EQUIPPED WITH A DETACHABLE APPLICATOR ELEMENT

(75) Inventor: Laure Thiebaut, Clichy (FR)

(73) Assignee: L'Oreal, Paris (FR)

( * ) Notice: Subject to any disclaimer, the term of this patent is extended or adjusted under 35 U.S.C. 154(b) by 513 days.

(21) Appl. No.: 11/221,709

(22) Filed: Sep. 9, 2005

(65) Prior Publication Data

US 2006/0056905 A1 Mar. 16, 2006

Related U.S. Application Data

(60) Provisional application No. 60/609,841, filed on Sep. 15, 2004.

(30) Foreign Application Priority Data

Sep. 10, 2004 (FR) ..... 04 52011

(51) Int. Cl.
*B43K 8/12* (2006.01)

(52) U.S. Cl. ..... 401/207; 401/202

(58) Field of Classification Search ..... 401/202–207
See application file for complete search history.

(56) References Cited

U.S. PATENT DOCUMENTS 4,758,217 A 7/1988 Gueret
5,122,158 A * 6/1992 Kuroda et al. ..... 8/137
5,322,382 A 6/1994 Hull et al.
5,785,193 A 7/1998 Kobayashi et al.
6,254,294 B1 7/2001 Muhar
6,547,471 B1 * 4/2003 Tucker et al. ..... 401/206
6,682,246 B2 * 1/2004 Reggiani ..... 401/264

(Continued)

FOREIGN PATENT DOCUMENTS

EP 0 727 361 8/1996

(Continued)

OTHER PUBLICATIONS

U.S. Appl. No. 11/688,828, filed Mar. 20, 2007, Thiebaut.

(Continued)

*Primary Examiner*—David J Walczak
(74) *Attorney, Agent, or Firm*—Oblon, Spivak, McClelland, Maier & Neustadt, L.L.P.

(57) ABSTRACT

A device for the application of a cosmetic and/or skin care product, includes an applicator element adapted for the application of the product. According to a preferred example, the device includes a first member having an aperture through which the applicator element extends, with a first part of the applicator element presenting an application surface projecting beyond a first side of the aperture. In addition, a second member forms a recess designed to receive therein a second part of the applicator element projecting beyond a second side of the aperture, with this second side being opposite the first side. The first member is connected to the second member by a hinge designed to pivot about an axis (Y) so as to allow the first member to move relative to the second member between a first position in which the second part is immobilized or held between the two members and a second position in which the applicator element is detachable.

29 Claims, 5 Drawing Sheets

U.S. PATENT DOCUMENTS

| | | | | |
|---|---|---|---|---|
| 6,688,795 | B1 * | 2/2004 | Jacob et al. | 401/207 |
| 2002/0020715 | A1 | 2/2002 | Gueret | |
| 2004/0089676 | A1 | 5/2004 | Greer, Jr. et al. | |

FOREIGN PATENT DOCUMENTS

| | | | |
|---|---|---|---|
| EP | 1 304 057 | A2 | 4/2003 |
| EP | 1 384 416 | A1 | 1/2004 |
| FR | 2 810 643 | | 12/2001 |
| JP | 61-150739 | | 9/1986 |
| JP | 7-277352 | | 10/1995 |
| JP | 2002-080082 | | 3/2002 |

OTHER PUBLICATIONS

U.S. Appl. No. 12/197,010, filed Aug. 22, 2008, Thiebaut.

* cited by examiner

DEVICE FOR PACKAGING AND APPLYING A PRODUCT EQUIPPED WITH A DETACHABLE APPLICATOR ELEMENT

CROSS-REFERENCE TO RELATED APPLICATIONS

This document claims priority to French Application Number 0452011, filed Sep. 10, 2004 and U.S. Provisional Application No. 60/609,841, filed Sep. 15, 2004, the entire content of which are hereby incorporated by reference.

FIELD OF THE INVENTION

The invention discloses a device for packaging and applying a product. The device is particularly advantageous for cosmetic products, and preferably includes a detachable applicator element.

BACKGROUND OF INVENTION

Discussion of Background

U.S. Pat. No. 4,758,217 describes a known applicator element designed to be placed above a pressurised container so as to receive the product dispensed from this container directly onto an application surface of the applicator element.

In various types of product applicator devices, and in particular those for the application of a cosmetic product, the applicator elements can deteriorate during the course of repeated use. It is desirable in this case to be able to readily remove the spent applicator element in order to wash it or replace it, without thereby impairing the operation of the device.

Moreover, from time to time certain users wish to use different types of applicator elements and in particular different application surfaces, depending on the area to which the product is to be applied.

U.S. Pat. No. 5,322,382 describes a known device for the application of a lotion on the skin. This device includes an applicator element in the form of a sponge covered with an adhesive layer to facilitate fixing of the applicator in a detachable manner on a holder of the device.

Sponges, and more generally all applicator elements that require coating with a layer of adhesive, pose problems of compatibility between the products to be applied and the adhesive used. Furthermore, when it becomes necessary to detach the applicator element from its holder, traces of glue remain on the holder thereby impairing proper adhesion of the applicator element to be attached thereto. After changing the applicator element several times, and as the adhesion of the applicator element weakens, the applicator is liable to become detached at the very moment when the product is being applied, with the risk of soiling the user's clothing. Also in the case where the user detaches the foam simply in order to wash it, the washing action is liable to cause the adhesive to disappear or become less effective. To fix the applicator, the user himself/herself will then have to apply glue to the applicator element in order to re-attach it to the holder. The device will therefore be more costly in that it will need to additionally include a dedicated reserve of glue.

In the current art, EP 1,304,057 also describes a known applicator device provided with an applicator element fixed in a detachable manner on a holder of this device by means of magnetic forces. These devices also pose a problem in that they are complicated and expensive to make. In effect, each applicator element, although detachable and disposable as the case may be, must include a magnet counterpart to the magnet provided on the portion of the device.

U.S. Pat. No. 6,254,294 also describes a known packaging and application device which includes a product container designed to be fitted with a detachable applicator element. To this end, the applicator element includes an applicator tip presented at the end of a tubular member so as to be capable of being mounted on and placed in relation to a tubular channel of the container. The tubular member is inserted on the tubular channel and held in place purely by frictional forces between the tubular carrier and the tubular channel.

Such a device also poses a problem in that there is considerable risk of the applicator element becoming inadvertently detached from the tubular channel. In effect, if the container is equipped with deformable sidewalls for the purpose of squeezing the product through the applicator element, this squeezing action is liable to disengage the applicator element from its dispensing aperture. Moreover, when the tip is applied against the skin, the contact force is liable to alter the relative positions of the tubular member relative to the tubular channel, which can modify the frictional forces thereby inducing inadvertent detachment. In both cases, at the moment of application, there is a risk that the applicator will soil the user. Finally, these devices are expensive to make as the applicator tip designed to be applied against the skin must be integral with its tubular holder, even though it is designed to be discarded after one application.

SUMMARY OF INVENTION

Thus, one of the objects of the invention is to provide a device that avoids or reduces the drawbacks of the prior art. The invention can provide an applicator element which is securely held on the device while allowing it to be detached.

It is another object of the invention to provide a device which preferably enables different applicator elements to be used.

A further object of the invention is to provide an applicator device in which the applicator element can be readily removed and it is possible to readily fit another or the same applicator element to the device.

Another object of the invention is to provide an applicator device of which the functionality is not impaired after having removed several applicator elements.

A further object of the invention is to provide such a device that is simple and inexpensive to make.

The present invention provides a device for packaging and applying a product, preferably a cosmetic product. According to one preferred example, the device includes a container holding the product, and an applicator device. The applicator device includes an applicator element having an application surface suitable for the application of said product, with the applicator element being designed to be placed in fluid communication with the container. The applicator device also includes a first member having an aperture through which the applicator element extends, with a first part of the applicator element presenting the application surface projecting beyond a first side of the aperture. In addition, the applicator device includes a second member forming a recess designed to receive therein a second part of the applicator element projecting beyond a second side of the aperture, with this second side opposite the first. The first member is connected to the second member by a hinge designed to pivot about an axis of rotation so as to allow the first member to move relative to the second member between a first position in which the second part is immobilised or held between the two members and a second position in which the applicator element is detachable.

In addition, the device is arranged to selectively close off the container.

Advantageously, the device is arranged to reversibly lock the two members in the first position, with the first position being adapted for application of the product.

By way of example, according to one embodiment, the first member preferably includes a protuberance capable of cooperating by a snap action with a counterpart projection on the second member, to form a locking arrangement.

According to one example, the first member includes two bosses each respectively engaged in a counterpart recess in the second member so as to form the hinge.

Preferably, the two members are monolithic and made in one piece. Also preferably, and by way of example, the hinge is provided by a film hinge, i.e. a bridge of resiliently deformable material formed between the two elements.

By way of example, the axis of rotation can be parallel to a surface defined by the second side of the aperture in the first member. In addition, preferably the hinge has a spring action to facilitate the movement from the first position to the second position, and vice versa.

Advantageously, the applicator element is at least partly composed of a porous material. It is thus able to take up a quantity of product that can be released at the moment of application, for example by capillary action or by simple pressure of the applicator element on the user in the case where the applicator element is at least partly resiliently deformable.

Preferably, the device includes a cap to enclose the applicator element in a leaktight manner when it is partly immobilised between the two members. Thus, when not in use, the applicator element can be protected against any soiling. This cap is designed to be held, for example by clipping or screwing, on the first member and/or the second member.

By way of example, to facilitate the manipulation of such a device, the device can include a grasping means integral with at least one of the two members.

In an alternative embodiment, the first member is arranged to mount the device on the container. The device is then capable of closing off the container, in a position such that the applicator element is inaccessible and can be placed in fluid communication with the product if desired.

In another embodiment, the second member includes an arrangement to mount the device on the container, with the second element including a passage to establish fluid communication between the seating designed to receive the second part of the applicator element and the container.

Further by way of example, a device according to the invention can include an arrangement for selective or permanent communication between the container and the applicator element.

The invention also provides a device which can be used for applying a cosmetic product, preferably in the form of a liquid, a gel or a cream, preferably a nail varnish remover, a makeup remover, a toning lotion or an anti-bacterial, or a skin treatment formulation. As a variant, the device according to the invention can also be used to apply a hair product to a lock of hair.

As should be apparent, the invention can provide a number of advantageous features and benefits. It is to be understood that, in practicing the invention, an embodiment can be constructed to include one or more features or benefits of embodiments disclosed herein but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will become further apparent from the following detailed description, particularly when considered in conjunction with the drawings in which.

DETAILED DESCRIPTION OF THE PREFERRED EMBODIMENTS

Figure 1:
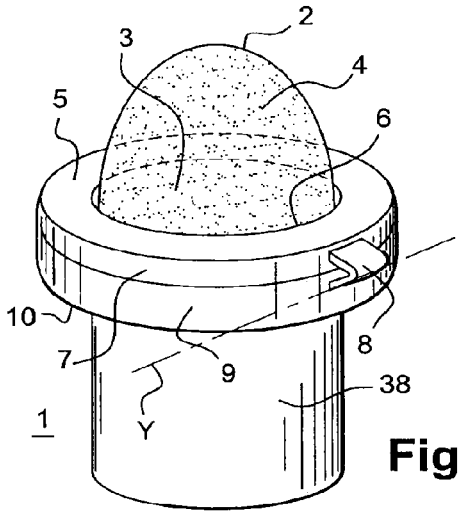
FIG. 1 is a perspective view of a device according to the invention in the first position.

FIG. 1 shows an example of a device 1 according to the invention designed to be mounted on a container (not shown) in a first position termed the usage or use position. In this example, an application surface 2 of an applicator element 3 projects beyond the external outline of the device 1. A first part 4 of this applicator element 3 presenting the application surface 2 projects beyond a first side 5 of an aperture 6 formed in a first member 7 of the device 1. In FIG. 1, the first side 5 partly defines the external outline of the device 1. In this example, this first side 5 surrounds the first part 4.

The first member 7 is connected by a hinge 8 to a second member 9 of the device 1. Preferably this hinge 8 is rotatable about an axis of rotation Y. In the usage position depicted in FIG. 1, the second member 9 is attached to and superimposed with respect to the first member 7. The hinge 8 is then considered to be in a "closed" position as the two members 7 and 9 thus immobilise the applicator element 3 between the outline of the aperture 6 formed by the first member 7 and this second member 9.

Preferably, this usage position is maintained by virtue of a reversible locking arrangement 11, for example by means of a snap action. For example, the device 1 is fitted with a reversible locking arrangement 11 at a point diametrically opposite the hinge 8. For example, this locking arrangement 11 includes a tab 11*a* projecting from the first member 7 and designed to be inserted by force into a counterpart aperture 11*b* in the second member 9. The positions of the tab and the counterpart aperture can be respectively reversed.

Figure 2:
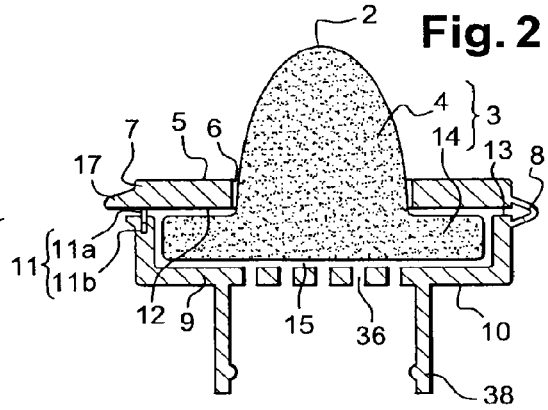
FIG. 2 is a lengthwise sectional view of a device according to the invention in the first position.

In the usage position, the applicator element 3 is preferably immobilised. In this example, the applicator element is configured so that it can only be withdrawn from the aperture 6 from a second side 12 of this aperture 6 opposite the first side 5. In the usage position, this second side 12 is held attached by the locking arrangement 11 against an upper surface 13 of a bottom 10 of the second member 9. The second side 12 is in fact inaccessible in the usage position shown in the sectional view in FIG. 2. FIG. 2 depicts a lengthwise sectional view, i.e. on a sectional plane oriented perpendicular to a plane in which the aperture 6 is defined at the level of the first side 5 of the first member 7.

To gain access to this second side 12, in order to be able to withdraw the detachable applicator element 3, the first member 7 is rotated about the axis Y relative to the second member 9, thereby moving them respectively from the usage position to a second position termed the "open" position.

Figure 3:
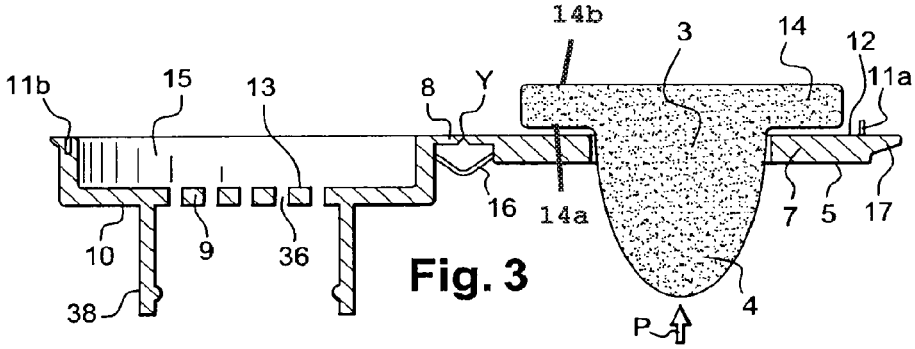
FIG. 3 is a lengthwise sectional view of a device according to the invention in the second position.

In this example, the applicator element 3 is configured to present a second part 14 designed to be held, and possibly compressed as the case may be, between the second side 12 and the upper surface 13. By way of example, the upper surface 13 is not flat, and preferably has a stepped profile, so that the second member 9 presents a seating 15 capable of receiving this second part 14 in a recess of this upper surface 13. As shown in FIG. 2, the second part 14 has a free end at a perimeter thereof, with parallel surfaces of the second part extending from the perimeter and respectively directly facing parallel surfaces of the first and second members 7, 9. As shown, the parallel surfaces of the second part and facing surfaces of the first and second members 7, 9 are substantially flat in the illustrated arrangement, and the first part 4 projects from the second part 14 at a location spaced from the perimeter. As can be seen in FIG. 3, the parallel surfaces of the second part include a first surface 14*a* of the second part of the applicator that directly faces the first member 7 and a second surface 14*b* of the second part of the applicator that directly faces the second member 9 when the applicator element 3 is held between the first and second members (see FIG. 2).

The seating 15 presents a cross-section substantially larger than the cross-section of the aperture 6, and the second part 14 is also preferably designed to have a larger cross-section than that of the aperture 6. Thus, this second part 14 is held between the outline of the aperture 6 on the second side 12 and this seating 15. The second part 14 forms a retaining collar around the first part 4.

By way of example, the aperture 6 preferably has a cross-section larger than any cross-section of the first part 4. Thus, the applicator element 3 can be detached from the first member 7 without difficulty from the second side 12. The first part 4 is then arranged to pass through the aperture 6 without friction. Alternatively, the first part 4 can present at least one cross-section larger than that of the aperture 6. The applicator element 3 can thus be held more securely in the usage position.

With this example, to be able to remove the applicator element 3 from the device 1, for example to replace it with another, it is first necessary to place the two members 7 and 9 in the "open" position, after rotating about the hinge 8, as shown in FIG. 3, so that the second side 12 is no longer against the upper surface 13. It thus becomes possible by exerting a pressure P, for example with the fingers, on the application surface 2 to push the first part 4 so as to cause it to pass through the aperture 6 and emerge at the second side 12.

Theoretically, from a certain angle, for example 60°, formed between the two members 7 and 9, it becomes possible to detach the applicator element 3. However in the embodiment where the hinge 8 is fitted with a spring-action arrangement 16, which entails a movement through an unstable angular position, manipulation of the applicator element 3 takes place when the two elements have assumed a stable angular position, for example for an angle between the upper surface 13 and the second side 12 of the order of 180° according to the embodiment in FIG. 3.

To facilitate the movement from the usage position to the open position, the first member 7 includes a grasping portion 17 designed to facilitate manipulation of the device 1. This portion 17 forms for example a protuberance projecting beyond the external outline of the device 1, preferably in a zone diametrically opposite the hinge 8.

Preferably, only one of the members 7 or 9 includes such a protuberance. The other of the members is designed to be held in the user's hand, while the user grasps the protuberance 17 with the other hand, and moves them apart by a pivoting action.

Preferably, the first and second members 7 and 9 are obtained by one-piece injection moulding of a thermoplastic material. They are then preferably injection moulded in the open position, as shown in FIG. 3, and in this case the hinge 8 is formed by a bridge of material between the first member 7 and the second member 9. For example, this bridge of material includes at least one lengthwise zone of weakness, or film hinge, at which the rotational movement can then be accomplished. The spring-action arrangement or spring 16 of the hinge 8 is formed for example, as depicted in FIG. 4, by two bridges of material, forming resilient connection strips 16*a* and 16*b* respectively disposed on either side of the hinge 8.

The term "spring-action hinge" refers to a hinge including at least one resilient connecting strip configured so as to be subjected to maximum resilient strain (either in extension or in compression) in an intermediate position between the usage position or closed position and the open position. The resilient strip is attached to each of the members so that the distance between the two points of attachment is variable in passing from the usage position to the open position. The strip has inherent resilience and can present an unstable balance position between these two positions.

Materials suitable for use in making the two members can include, without this list being limitative or exhaustive, homopolymer or copolymer polypropylene, polyethylene, in particular high density or medium density polyethylene. The two members can also be bi-injection moulded.

Figure 4:
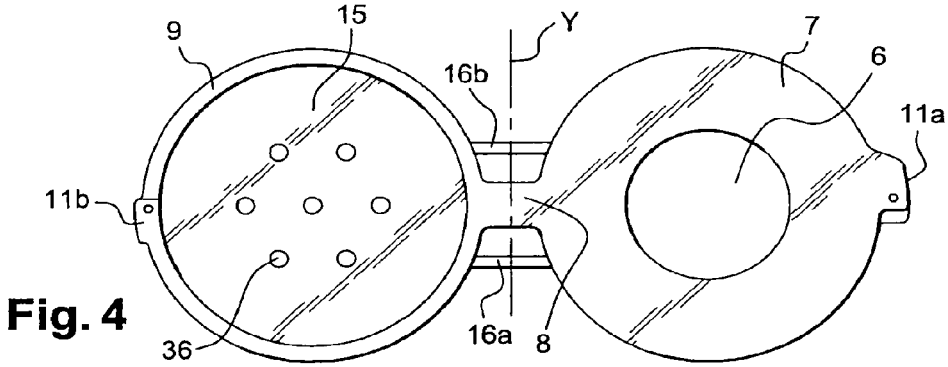
FIG. 4 is a top view of a device according to the invention in the second position.

In the embodiment illustrated in FIG. 4, the locking arrangement 11 differs from that in FIGS. 1 and 3 and in this case takes the form of two tabs respectively projecting beyond the external outline of each of the two members 7 and 9. One of the tabs and preferably both tabs have a boss capable of snapping onto the tab of the corresponding member or the opposing tab, or alternately the bosses can be designed to cooperate directly with each other to effect the locking action.

For example, the first and second members 7 and 9 respectively have a substantially cylindrical shape so that in the usage position or closed position they are superimposed on each other to form a cylinder. Also by way of example, the cylinder formed by these two superimposed members is of square, oval or polygonal cross-section. The hinge 8 is then defined at an outer lateral surface of the cylinder formed by these two members.

The first side 5 defines for example a substantially circular surface in the middle of which the aperture 6 is formed such that a bottom 10 opposite this first side 5 is of substantially identical cross-section to that of the first side 5. Preferably, in the usage position, this bottom 10 is parallel to the first side 5.

In this example, the seating or recess 15 has a circular cross-section. Alternatively it can be square, oval or any polygonal shape, for example. Generally, the applicator element 3 is chosen so that the second part 14 has the same shape as seating 15, preferably with the second part 14 having a cross-section substantially identical to that of the seating 15. For example, the second part 14 can be of circular cross-section, or alternatively square, oval or polygonal cross-section. Preferably, the second part 14 is not compressed radially by the periphery of the seating 15.

In the example in FIG. 4, the aperture 6 has a circular cross-section. Alternatively, however, it can also be of square cross-section, oval or any polygonal shape, for example. Generally, the applicator element 3 is chosen so that the first part 4 has a cross-section matching that of the aperture 6. Alternatively, the cross-section of the first part 4 is only designed to fit within or pass through the cross-section of the aperture 6.

Figure 5:
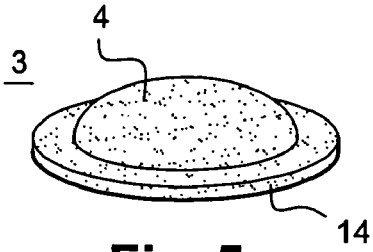
FIG. 5 is a perspective view of an applicator element designed to be placed in a device according to the invention.

The cross-sections of the first and respectively the second parts 4 and 14 can be chosen independently of each other. In effect, the first part 4 can be of circular cross-section, while the cross-section of the second part 14 can be square, without impairing the operation of the device 1. Preferably, however, they are chosen to match each other, as shown in FIG. 5. For example, the outer periphery of the first part can have a shape the same as that of the outer periphery of the second part, with the outer periphery of the second part being larger. Also by way of example, a cross-section of the first part can have a shape the same as a cross-section of the second part with the cross-section of the second part larger. As a further alternative, the outer periphery or cross-section of the second part can have the same shape but smaller than that of the first part. As a further alternative, the cross-sections or outer peripheries of the first and second parts can have the same size. Further, although the shapes are preferably the same or corresponding, the shapes of the first and second parts could be different. As shown in the drawings, and also by way of example, the first part extends to a height higher than that of the second part in an uncompressed or undeformed state. Also by way of example, the height of the first part itself can be larger than that of the second part in an uncompressed or undeformed state. Preferably, the first part can include a protrusion which protrudes from the second part in an uncompressed or undeformed state.

Figure 6:
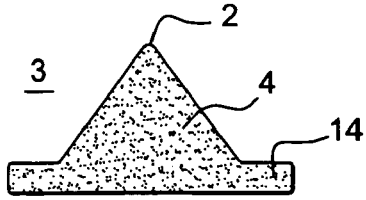
FIGS. 6 to 8 are lengthwise sectional views of alternative embodiments of applicator elements each designed to be placed in a device according to the invention.
Figure 7:
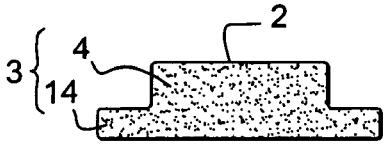

In the examples in FIGS. 1 and 5, the first part 4 forms a dome of circular cross-section. This dome can be more or less pronounced so as to project as desired more or less beyond the plane formed by the first side 5, and so as to present a more or less convex application surface 2. Alternatively, the first part 4 can be conical or pyramid-shaped as shown in FIG. 6, thereby offering a more or less pointed application surface 2. As a further variant, the first part 4 can be cylindrical as shown in FIG. 7, thereby offering a flat application surface 2.

Figure 8:
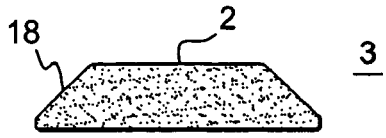

Alternatively, as a further variant, as shown in FIG. 8, the applicator element 3 is shaped to form a truncated cone or truncated pyramid. In the case where the first part is additionally made of a resiliently deformable material, the oblique walls 18 of such an applicator element 3 can then be compressed by the periphery of the aperture 6 at the second side 12 so as to impart, nonetheless, a domed shape to the application surface 2, although the latter is initially shaped to be flat in the at-rest or uncompressed position.

For example, the applicator element 3 can be made of an agglomerate material, in particular thermoplastic or ceramic, or a resiliently compressible material, in particular a closed, open or semi-open cell foam or an elastomer, or an arrangement of superimposed layers of one or more of these materials. The foam can be obtained for example from polymers such as polyethylene, polypropylene, nylon EVA (ethylene vinyl acetate), polyvinyl acetate, polyester or polyurethane. It can also be made of fibre, cotton, or felt. The application surface 2 can also be made of a flock material, for example using fibres of rayon, cotton, viscose or nylon, thereby rendering it softer to the touch. More preferably, the applicator element 3 is porous, at least at the application surface 2, so as to take up a quantity of product to be applied.

In the case where the first part 4 is made of a flexible and compressible material, the height of this first part 4 is preferably chosen such that, even when the first part 4 is brought to its limit of lengthwise compression, the application surface 2 remains above the level formed by the first side 5. In particular, the first part 4 can be brought to such a level of compression when it is applied on a surface. In effect, the application exerts a pressure P on the element 3. This arrangement thus prevents the first part 4 from being pushed back into the seating 15 during application, and the user is therefore at no risk of injury or discomfort from unwanted friction between her skin and the edge of the first member 7 delineating the aperture 6.

Figure 17:
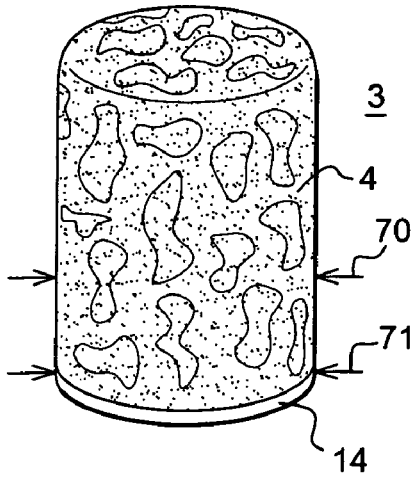
FIG. 17 is a lengthwise sectional view of another variant of an applicator element designed to be placed in a device according to the invention.

In another example of an embodiment, depicted in FIG. 17, the applicator element 3 has a cylindrical structure such that, when no pressure is being applied, the first part 4 has a cross-section identical to a cross-section of the second part 14. In particular, the applicator element 3 is of circular cross-section, the first part 4 presenting a diameter 70 substantially equal to a diameter 71 of the second part 14.

The first part 4 in this example can be made of a resiliently deformable material, at least radially compressible, so as to be capable of being compressed as it passes through the aperture 6. In particular, the first part 4 includes at least one cross-section radially compressed at the level of the aperture 6 when the second part 14 is abutted against the second side 12 (see, e.g., FIG. 18). Beyond the aperture 6, on the first side 5, the first part 4 decompresses and again presents a cross-section slightly larger than that of the aperture 6. Leakage of the product is thus prevented.

By way of example the first part 4 is made of an open-cell polyurethane foam having a density between 20 and 40 $kg/m^3$, and preferably of the order of 32 $kg/m^3$. In addition, the second part 14 is made in the form of a rigid sheet of polyethylene, preferably of limited thickness. The first part 4 is for example glued to the second part 14. Preferably, a two-layer structure is made from a sheet of polyethylene to which a layer of polyurethane foam is bonded using a liquid polyurethane adhesive, applicator elements such as 3 then being cut out from this two-layer structure using a cylindrical die-cutter in this example.

Figure 9:
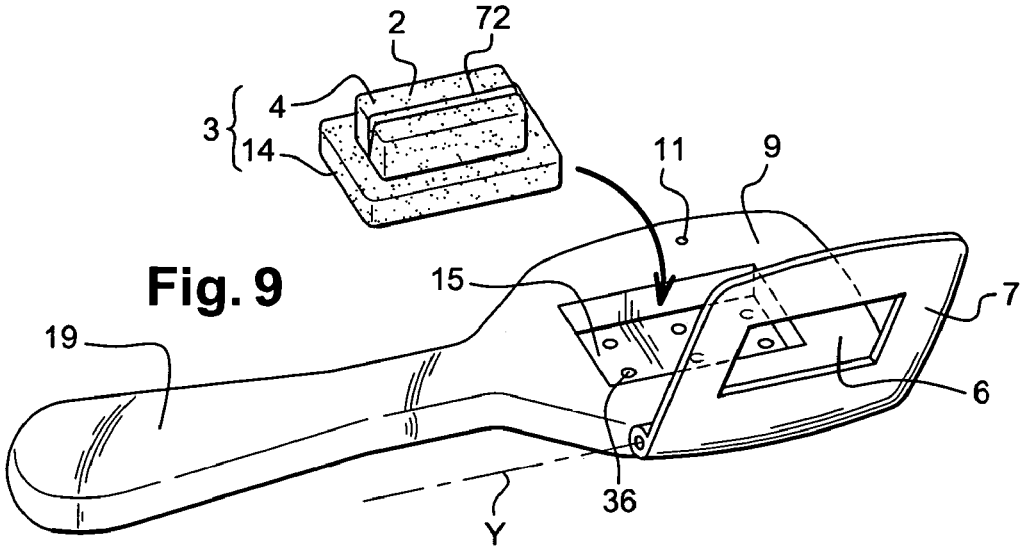
FIGS. 9 and 10 are exploded perspective views of a device according to the invention equipped with a grasping arrangement.

In accordance with one embodiment or example, in particular depicted in FIG. 9, the second member 9 is extended by a grasping means 19.

In the embodiment in FIG. 9, the grasping portion 19 forms a handle extending from the bottom 10. It is for example cut out as an extension of the second member 9. The axis Y is then for example parallel to an axis of this handle 19. In particular, in FIG. 9, the first member 7 is pivoted on the second member 9 by a conventional hinge incorporating a fitted pin about which the rotational movement can be effected, this fitted pin being inserted through a recess provided in the first member 7 and a recess provided in the second member 9. In this example, the seating 15 is parallelepipedic and capable of receiving the second part 14 also of parallelepipedic shape, and the aperture 6 is rectangular to allow the first part 4, also of parallelepipedic shape, to project beyond it. In this embodiment, the reversible locking arrangement 11 is presented in the form of a stud designed to be inserted into a counterpart aperture or recess on the upper surface 13.

By way of example, in another aspect of the invention, shown in particular in the context of the embodiment illustrated in FIG. 9, the first part 4 can include a slot 72 emerging at the application surface 2. This slot 72 is preferably configured to receive a lock of hair. As well as being able to be applied to the skin, the device according to the invention can thus be applied to the hair. Preferably, once the lock of hair is positioned in the slot, the device is moved from the roots to the tips of this lock of hair to deposit a product, for example a coloring product.

Figure 10:
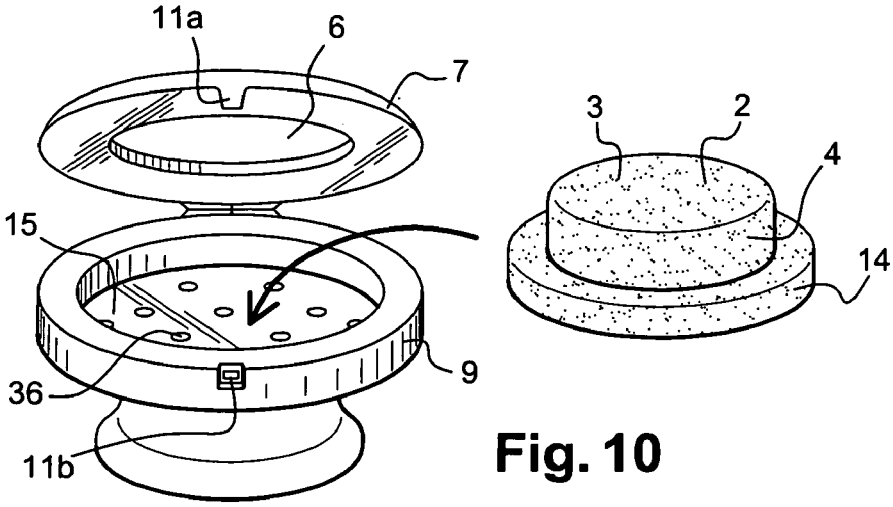

As a variant, in the embodiment in FIG. 10, the seating 15, the second part 14, the first part 4 and the aperture 6 are of oval cross-section. In this embodiment, the reversible locking arrangement 11 takes the form of a tab 11*a* standing orthogonally to the outline of the second side 12 and capable of engaging by snap action with a counterpart projection 11*b* on the external outline of the second member 9.

The user can for example use the device 1 to smooth out and/or spread a product, for example a makeup, dispensed via the applicator element 3 the latter being mounted on a container 22 holding said product. To this effect, the device 1 can include, in particular as illustrated in FIGS. 1 to 4 and 10, an arrangement or assembly to facilitate mounting on a container. In particular, the second member 9 can include at least one aperture 36, and in this instance a plurality of apertures 36, passing through the bottom 10 so as to be capable of feeding product to the applicator element 3 via its second part 14 disposed in the seating 15. A mounting skirt 38 extends from the bottom 10 so as to be capable in particular of being retained on a neck for example 23 of a container 22 containing the product so as to be in fluid communication with the contents of this container.

Preferably, the device 1 is provided with a series of applicator elements such as 3 in the case where the user wishes to change the applicator between two applications or during the same application to obtain different effects. In the latter case, the various applicator elements provided with the device 1 can present application surfaces having different a shape, surface condition (or texture or roughness) or hardness.

Figure 11:
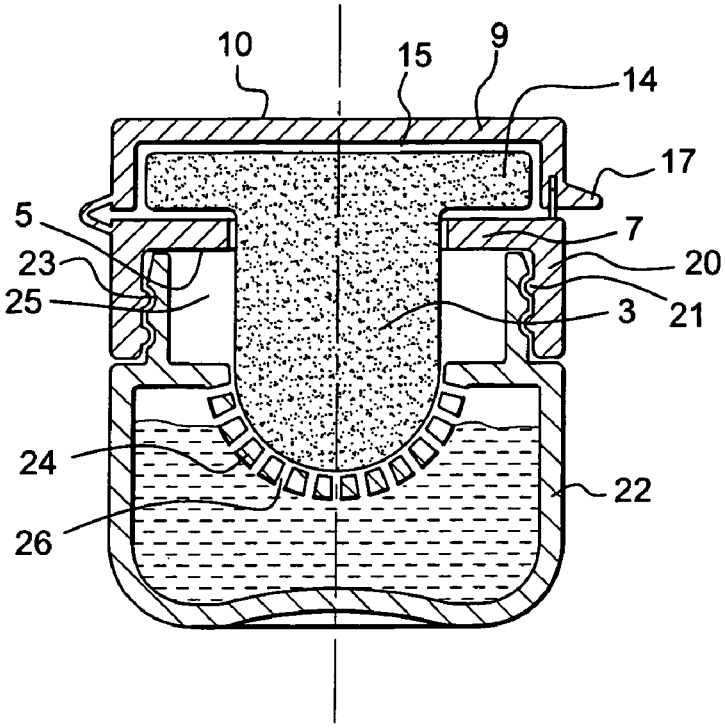
FIGS. 11 and 12 are lengthwise sectional views of alternative embodiments of devices according to the invention, each respectively mounted on a container to respectively form devices according to the invention.

In another embodiment depicted in FIG. 11, the first member extends from the first side 5 by a peripheral skirt 20 incorporating a fixing arrangement 21 for attachment to a container 22 holding a product. The peripheral skirt 20 stands perpendicular to the first side 5. The device 1 can then be attached by screwing onto the external periphery of a neck 23 of the container 22. Preferably, the container 22 includes a transverse wall 24 delineating a seating 25 designed to receive the protruberant first part 4 of the applicator element 3 when the device 1 is mounted on the neck 23. This transverse wall 24 includes at least one communicating aperture 26 between the inside of the container and the seating 25. The application surface 2 can thus be in fluid communication with the product. For example, with the device 1 in the mounted position on the neck 23, the applicator element 3 is resiliently compressed in its seating 25. The device 1 is configured so that when the device 1 is in the detached position relative to the neck 23, the application surface 2 projects beyond the outline delineated by the peripheral skirt 20.

Figure 12:
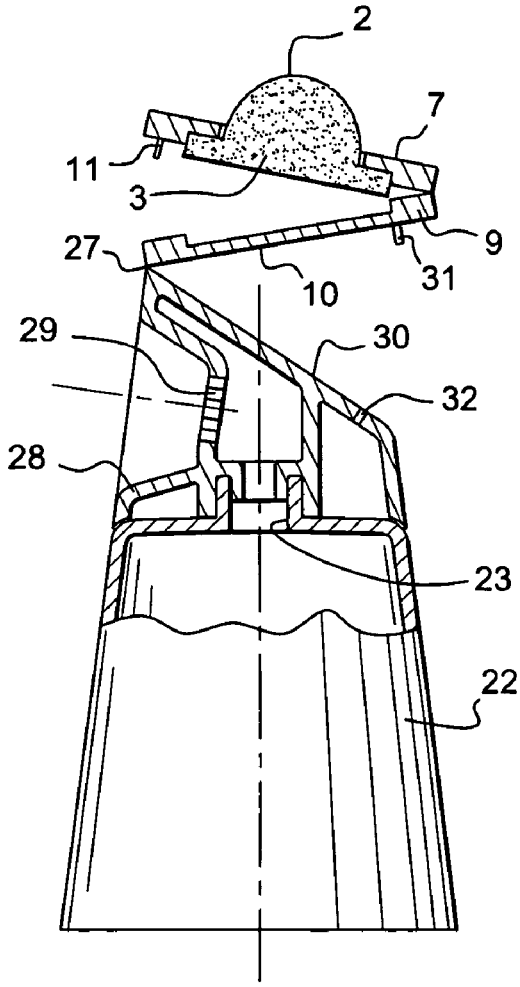

Alternatively, as shown in FIG. 12, a device such as 1 is attached by a film hinge 27 to an adapter 28 designed to be mounted on the neck 23 of a container 22. The device 1 is designed to be rotated around this film hinge 27 between a closed position in which it closes off an aperture 29 in this adapter 28, itself in fluid communication with the container 22, and an application position in which it is held on an external perimeter 30 of this adapter 28, the application surface 2 then projecting beyond this perimeter 30 to be brought into contact with a desired surface. The adapter 28 and the members 7 and 9 can for example be moulded in one piece.

The adapter 28 is in fluid communication with the contents of the container, in the closed position, and the application surface 2 is then capable of being placed in contact with the product held in the container 22. For example, the film hinge 27 is formed between the second member 9 and the adapter 28, and the first side 5 of the first member 7 then includes an arrangement (not shown) to lock the closed position. Whereas to maintain the application position, the bottom 10 of the second member 9 includes reversible attachment arrangement such as a stud 31 designed to reversibly snap onto a counterpart projection 32 on the outer periphery of the adapter 30.

Figure 13:
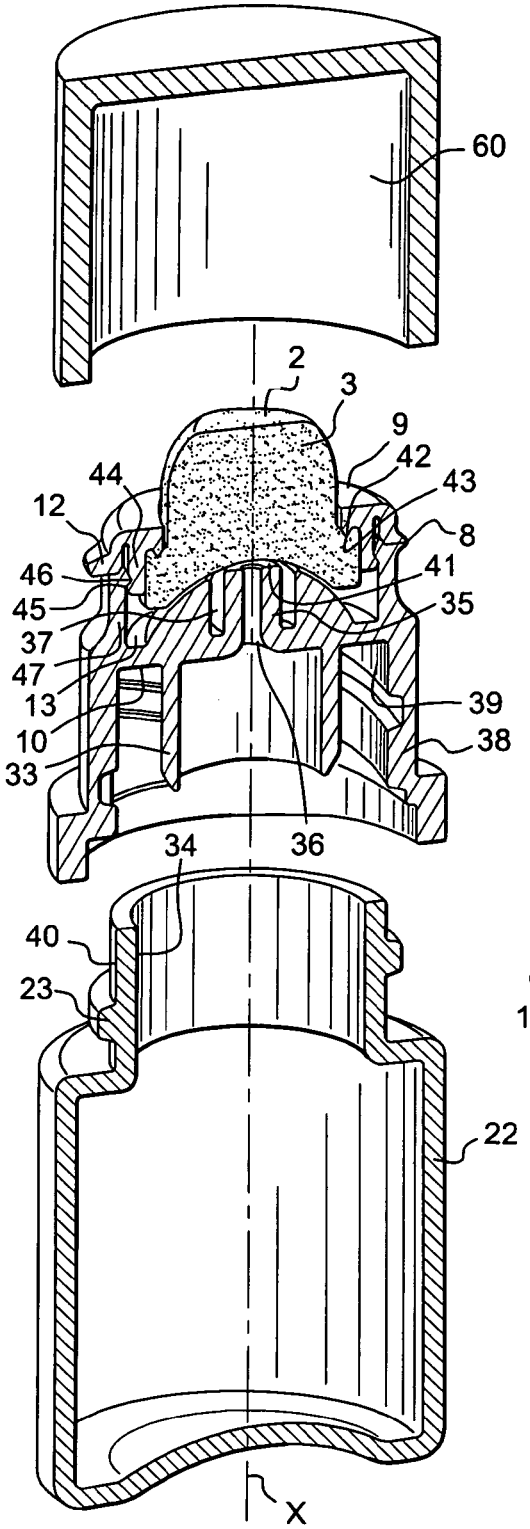
FIG. 13 is a lengthwise exploded sectional perspective view of a preferred embodiment of a device according to the invention.
Figure 15:
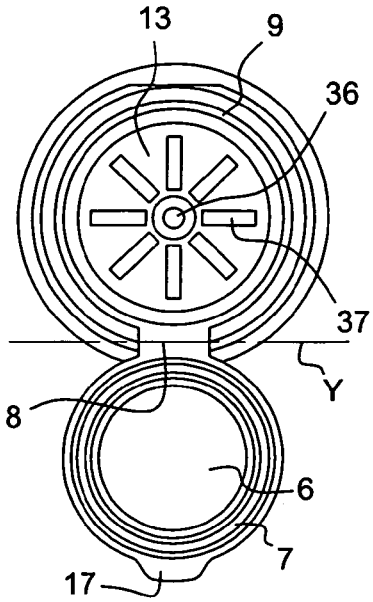
FIG. 15 is a top view of the device in FIG. 14.
Figure 14:
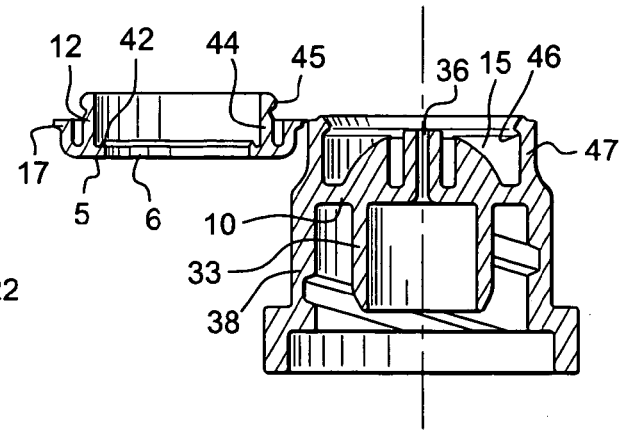
FIG. 14 is a lengthwise sectional view of the device according to the invention illustrated in FIG. 13, with the device in the second position.

In a preferred embodiment, depicted in FIGS. 13, 14 and 15, the bottom 10 is provided with at least one, but preferably several, through aperture(s) 36 to be placed in fluid communication with a container such as 22 on the neck 23 of which the second member 9 is mounted. Extending beyond the bottom 10, the second member 9 includes a first annular sealing lip 33 of axis X, arranged to be applied in a leaktight manner on the inner surface 34 of the neck 23. In particular, the view in FIG. 13 is shown in a sectional plane parallel to the axis X.

This first annular lip 33 defines a passage passing through the second member 9 to emerge through a dome 35 formed in the upper surface 13. The upper surface 13 thus presents a convex profile. The dome 35 serves to limit the depression of the applicator element 3 into the seating 15 when a pressure P is exerted on the application surface 2. Even during the application of such a pressure, and even if the element is taken to its compression limit, the application surface is held at a level above the first side 5 of the aperture 6.

The passage emerges into the seating 15 via a central dispensing aperture 36 in this dome 35, thereby enabling fluid communication between the container 22 and the seating 15. The dome 35 can include grooves 37 of elongated shape and arranged in a star pattern, for example, around the central dispensing aperture 36, to lighten the structure of this upper surface 13.

Extending from the bottom 10, the second member 9 also includes a mounting skirt 38 for example provided on its inner surface 39 with a screw thread designed to cooperate by screw action with a counterpart screw thread provided on the external surface 40 of the neck 23.

An applicator element 3 designed to be fitted in such a seating 15 includes for example a concave surface 41 at the level of its second part 14, opposite the application surface 2, to present a shape counterpart to the dome 35. Alternatively, this second part 14 can be compressed, in the usage position or closed position, between the upper surface 13 in the shape of a dome 35 and the second side 12 of the first member 7.

In this example, the second part 14 forms an annular collar around the first part 4 of convex and truncated shape. Preferably, at the level of the second side 12, a groove 42 surrounding the aperture 6 is designed to mate with an upper surface 43 of this first part 14, thereby improving retention of the applicator element 3 between the two members 7 and 9, and preventing any movement of the applicator element 3 along axis X.

Extending beyond the second side 12, the first member 7 includes an annular lip 44 provided with an annular bead 45, which can be continuous or discontinuous, designed to snap into a corresponding groove 46, also annular, presented on the inner surface of an annular peripheral skirt 47 projecting beyond the upper surface 13, and surrounding the dome 35 at which the central dispensing aperture 36 emerges. The annular bead 45 and the groove 46 form an alternative embodiment of the reversible locking arrangement 11.

In this preferred embodiment, the members 7 and 9 are also preferably made in one piece, by injection moulding or forming a thermoplastic material. A film hinge is then provided to form the hinge 8. The axis Y about which the first member 7 is rotatably moved is orthogonal to the lengthwise axis X of the neck 23, and is also preferably parallel to the plane in which the aperture 6 emerges at the first side 5.

The device 1 and the container 22 together form a device for packaging and applying a product held in the container 22. The product is fluid so as to be able to flow through the central dispensing aperture 36. For example, the product is a nail varnish remover. Thus it becomes easy to remove the varnish present on the nail of one hand without spoiling the varnish on the other nails of both hands, in particular without spoiling the varnish on the hand holding the applicator element charged with remover.

Figure 16:
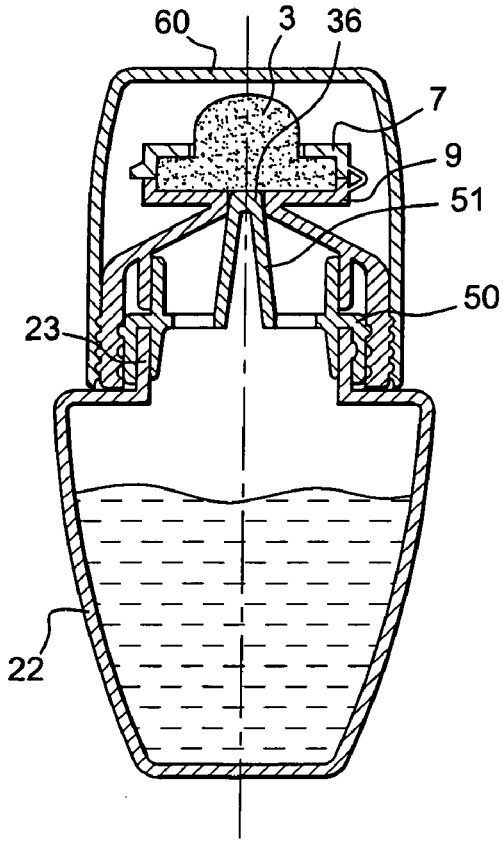
FIG. 16 is a lengthwise sectional view of an alternative embodiment of a device according to the invention.

As a variant of this preferred embodiment, as illustrated in FIG. 16, and as taught in particular by document EP 1,384,416, the device according to the invention can include a container 22 of lengthwise axis X designed to contain the product, with the applicator element 3 being designed to be in fluid communication with the product held in the container via a dispensing aperture such as 36 formed through the second member 9, this device having the particular feature of being fitted with an intermediate part 50 between the second member 9 and the neck 23 of the container 22.

This intermediate part 50 is mounted, for example by a snap-on attachment, on the outer surface of the neck 23, and the second member 9 is held, for example by screwing, on the outer surface of this intermediate part 50. The intermediate part 50 presents a spike 51 designed to allow opening/closing of the dispensing aperture 36 formed through the second member 9 in relation to the position of this second member 9 relative to the intermediate part 50. Rotation of the second member 9, integral with the first member 2 and of the applicator element 3, facilitates the transition from a first position in which the dispensing aperture 36 is closed to a second position in which the dispensing aperture is open.

The user can selectively choose whether or not to use the applicator element with continuous delivery of product. Furthermore, the spike 51 makes it possible to vary the flow in relation to the rotation applied to the second member 9 relative to the intermediate part 50.

In addition, the device according to the invention can include a closure cap 60 designed to be attached, for example by means of a screw thread, to the device 1 or the intermediate part 50 as the case may be, thereby forming a closed and leaktight recess for the applicator element 3 and to close off the container 22. Thus, a cap 60 can be provided as an example of a means to close off the container. According to alternate examples, as discussed earlier and shown in FIGS. 11 and 12, the first member can be mounted to provide a means to close off the container in a closed position. In the examples of FIGS. 11 and 12, in the closed position, the applicator is not accessible and can be placed in fluid communication with the product.

Similarly for the preferred embodiment, in particular shown in FIGS. 13 to 15, the outer surface of the mounting skirt 38 can include a screw thread (not shown) designed to engage with a cap such as 60. This cap 60 can furthermore be provided with a compartment wherein a reserve containing at least one spare applicator element such as 3 is provided. Preferably, access to this compartment can be effected without detaching the cap 60 from the device 1.

Figure 18:
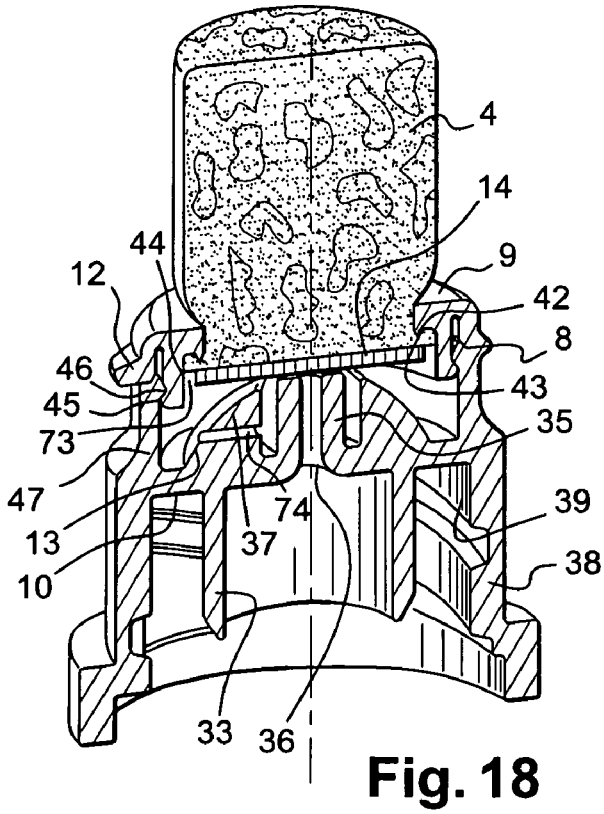
FIG. 18 is a lengthwise sectional perspective view of a device according to the invention fitted with an applicator element of the type depicted in FIG. 17.

In another variant, illustrated in FIG. 18, of the preferred embodiment, the applicator element 3 is of the type described in FIG. 17. A particular feature of this other variant is that the second part 14 is allowed a small amount of play 73 in its seating 15 so as to facilitate the flow of product at the periphery of the second part 14, the latter being impermeable to the product. In parallel, to prevent the plate presented by the second part 14 from closing off the central dispensing aperture 36, the channel 35 can include a side outlet or channel 74 emerging into the seating 15 via the projections 37. This side outlet 74 emerges in a direction for example at 90° to the central aperture.

Throughout the description and claims herein, the expressions such as "including one," "having one" or "has one", etc. should be regarded as synonymous with "including at least one", unless otherwise specified. The same is also true for expressions of high numbers such as "including two," etc.

In the foregoing detailed description reference is made to preferred embodiments of the invention. It is evident that variants thereto can be proposed without departing from the invention as claimed here below. It is therefore to be understood that, within the scope of the appended claims, the invention may be practiced otherwise than as specifically described herein.

The invention claimed is:

1. A device for packaging and applying a product, including:

(a) a container holding a product; and (b) an applicator device including:

(i) an applicator element which includes an application surface suitable for the application of said product, wherein the applicator element is designed to be placed in fluid communication with the container, and wherein the applicator element includes a first part and a second part with the first part including the application surface, and further wherein the second part includes a free end at a perimeter thereof, and wherein said second part includes a first surface and a second surface, and said first part projects from said first surface at a location spaced from the perimeter of the second part, and wherein the first part and the second part are formed as a single, one-piece element;

(ii) a first member including an aperture through which the applicator element extends, wherein the application surface of the first part of the applicator element projects beyond a first side of the aperture, and wherein a second side of the aperture is opposite the first side; and (iii) a second member forming a recess which receives therein the second part of the applicator element projecting beyond the second side of said aperture, wherein the first member is connected to the second member by a hinge designed to pivot about an axis of rotation so as to allow the first member to move relative to the second member between a first position in which the second part is held between the first and second members and a second position in which the applicator element is detachable, and wherein in the first position said first surface of the second part of the applicator directly faces the first member and the second surface directly faces the second member to retain the second part of the applicator between the first and second members, wherein the device includes means to selectively close off said container.

2. A device according to claim 1, wherein the device includes means to reversibly lock the first and second members in the first position for application of said product.

3. A device according to claim 1, wherein the first member includes a protuberance capable of cooperating by snap action with a counterpart projection on the second member.

4. A device according to claim 1, wherein the first and second members are monolithic and made in one piece.

5. A device according to claim 1, wherein the hinge includes a film hinge.

6. A device according to claim 1, wherein the axis of rotation is parallel to a surface defined by the second side of the aperture in the first member.

7. A device according to claim 1, wherein the hinge has a spring action.

8. A device according to claim 1, wherein the applicator element is composed at least partly of a porous material.

9. A device according to claim 1, wherein the applicator element is formed at least partly of a resiliently deformable material.

10. A device according to claim 1, wherein the device includes a grasping means integral with at least one of the first and second members.

11. A device according to claim 1, wherein the means to selectively close off the container includes a cap to enclose the applicator element in a leaktight manner when it is held between the two members.

12. A device according to claim 1, wherein the means to selectively close off the container includes a mounting arrangement to position the first member in a closed position in which the first member closes off the container, and wherein in said closed position the applicator element is inaccessible and can be placed in fluid communication with the product.

13. A device according to claim 1, wherein the second member includes means to mount the device on the container, and wherein the second member includes a passage to establish fluid communication between the recess which receives the second part of the applicator element and the container.

14. A device according to claim 1, wherein the product inside the container is a cosmetic product.

15. A device according to claim 14, wherein the cosmetic product is one of a liquid, a gel or a cream.

16. A device according to claim 1, wherein the cosmetic product is selected from the group consisting of: a nail varnish remover, a makeup remover, a toning lotion, an anti-bacterial, and a skin treatment formulation.

17. A device according to claim 1, wherein an outer periphery of the first part of the applicator element is smaller than an outer periphery of the second part.

18. A device according to claim 17, wherein the outer periphery of the first part has a shape which is the same as the outer periphery of the second part.

19. A device according to claim 1, wherein in an undeformed state of the applicator element, the first part extends to a height higher than the second part.

20. A device according to claim 1, wherein the first part of the applicator element protrudes from the second part in an undeformed state.

21. A device according to claim 1, wherein a plurality of said applicator elements are provided so that the applicator elements can be exchanged, and wherein the device holds only one of said applicator elements at a time.

22. A device according to claim 1, wherein in said first position said first part of said applicator element is in an undeformed state when not being used to apply a product.

23. A device according to claim 1, wherein a top surface of said first member on said first side of said aperture is substantially flat.

24. A device according to claim 1, wherein in an undeformed state, an outer periphery of the first part of the applicator element has substantially the same size and shape as the aperture.

25. A device for packaging and applying a product, including:

(a) a container holding a product; and (b) an applicator device including:

(i) an applicator element which includes an application surface suitable for the application of said product, wherein the applicator element is designed to be placed in fluid communication with the container, and wherein the applicator element includes a first part and a second part with the first part including the application surface;

(ii) a first member including an aperture through which the applicator element extends, wherein the application surface of the first part of the applicator element projects beyond a first side of the aperture, and wherein a second side of the aperture is opposite the first side; and (iii) a second member forming a recess which receives therein the second part of the applicator element projecting beyond the second side of said aperture, wherein the first member is connected to the second member by a hinge designed to pivot about an axis of rotation so as to allow the first member to move relative to the second member between a first position in which the second part is held between the two members and a second position in which the applicator element is detachable; and wherein the applicator device is movable relative to said container, and wherein in a first position said first part of the applicator element extends in a direction toward the container to pick up product from said container and in a second position the first part extends in a direction away from the container for application of the product.

26. A device according to claim 1, wherein the first and second surfaces of the second part of the applicator element are substantially parallel and respectively face parallel portions of the first member and the second member in the first position.

27. A device according to claim 26, wherein the first and second surfaces of the second part of the applicator are substantially flat and the parallel portions of the first and second members are substantially flat.

28. A device according to claim 1, wherein said first part and said second part are formed of the same material.

29. A device according to claim 1, wherein said first surface and said second surface of said second part extend substantially parallel to each other from the free end at the perimeter of the second part to the application surface of the first part of the applicator element.

* * * * *